US007531996B2

(12) United States Patent
Yang et al.

(10) Patent No.: US 7,531,996 B2
(45) Date of Patent: May 12, 2009

(54) LOW DROPOUT REGULATOR WITH WIDE INPUT VOLTAGE RANGE

(75) Inventors: Ta-Yung Yang, Milpitas, CA (US); Chih-Ho Lin, Hsinchu (TW)

(73) Assignee: System General Corp., Taipei (TW)

( * ) Notice: Subject to any disclaimer, the term of this patent is extended or adjusted under 35 U.S.C. 154(b) by 254 days.

(21) Appl. No.: 11/602,357

(22) Filed: Nov. 21, 2006

(65) Prior Publication Data

US 2008/0116862 A1 May 22, 2008

(51) Int. Cl.
*G05F 1/40* (2006.01)

(52) U.S. Cl. ..... 323/282; 323/280

(58) Field of Classification Search ..... 323/282–290, 323/272–275, 266–268, 234; 327/538–543, 327/434

See application file for complete search history.

(56) References Cited

U.S. PATENT DOCUMENTS 5,365,161 A * 11/1994 Inoue et al. ..... 323/282
5,929,617 A * 7/1999 Brokaw ..... 323/280

* cited by examiner

*Primary Examiner*—Rajnikant B Patel
(74) *Attorney, Agent, or Firm*—Banger Shia

(57) ABSTRACT

A low dropout (LDO) regulator operates in wide input range. The LDO includes an N-type pass transistor and a P-type pass transistor for supplying power to the output terminal. The P-type pass transistor is connected with N-type pass transistor in parallel. Two error amplifiers control the gate terminals of the N-type pass transistor and P-type pass transistor to generate a first output voltage and a second output voltage. Thus, the first output voltage is generated when the input voltage is higher than a threshold voltage, and the second output voltage is generated when the input voltage is lower than the threshold voltage.

9 Claims, 5 Drawing Sheets

LOW DROPOUT REGULATOR WITH WIDE INPUT VOLTAGE RANGE

BACKGROUND OF THE INVENTION

1. Field of Invention

The present invention relates to voltage regulator circuits, and more particularly to low dropout regulators with wide input voltage range.

2. Related Art

Voltage regulators with a low dropout (LDO) are commonly used in the power management systems of computers, mobile phones, automobiles and many other electronic products. Power management systems use LDO regulators as local power supplies, where a clean output and a fast transient response are required. LDO regulators enable power management systems to efficiently supply additional voltage levels that are smaller than the main supply voltage. For example, the 5V or 12V power systems use LDO regulators to supply local chipsets and memories with a clean 2.5V and 3.3V signal.

Although LDO regulators do not convert power very efficiently, they are inexpensive, small, and generate very little frequency interference. Furthermore, LDO regulators provide a local circuit with a clean voltage that is unaffected by current fluctuations from other areas of the power system. LDO regulators are widely used to supply power to local circuits when the power consumption of the local circuit is negligible with respect to the overall load of a power system.

An ideal LDO regulator should provide a precise DC output, while responding quickly to load changes and input transients. Since LDO regulators are widely used in mass-produced products such as computers and mobile phones, simple design and low production costs of LDO regulators are also desirable.

A typical regulator consists of a feedback-control loop coupled to a pass element. The feedback-control loop modulates the gate voltage of the pass element to control its impedance. Depending on the gate voltage, the pass element supplies different levels of current to an output section of the power supply. The gate voltage is modulated such that the regulator outputs a steady DC voltage, regardless of load conditions and input transients. FIG. 1 shows a conventional circuit of a source-follow regulator. The source-follow regulator includes an N-type pass transistor 10, a feedback-control circuit 11, and a voltage divider 12 having a voltage divider point FB, and two resistors 121 and 122. The source-follow regulator receives an unregulated DC input voltage $V_{IN}$ and outputs a regulated DC output voltage $V_O$. The feedback-control circuit 11 includes an error amplifier 15 and a reference voltage $V_{REF}$ is transmitted to the positive input of the error amplifier 15. The output of the error amplifier 15 is connected to the gate terminal G of the N-type pass transistor 10. The unregulated DC input voltage $V_{IN}$ is transmitted to the drain terminal D of the N-type pass transistor 10. The source terminal S of the N-type pass transistor 10 outputs the regulated DC output voltage $V_O$. The DC output voltage $V_O$ is transmitted from the feedback-control circuit 11 through the voltage divider 12. The resistors 121 and 122 are connected in series between the regulated DC output voltage $V_O$ and the ground reference. The voltage divider point FB is between the resistors 121 and 122 and connected back to the negative input of the error amplifier 15.

The advantage of the source-follow regulator is good stability. The N-type pass transistor 10 provides attenuation to the feedback loop. The error amplifier 15 mainly controls the loop gain, which easily achieves adequate phase margin and gain margin. Another advantage of the source follow regulator is high PSRR (power supply rejection ratio). The N-type pass transistor 10 receives the unregulated DC input voltage $V_{IN}$ from the drain terminal D, which develops high impedance to resist the noise from the input voltage $V_{IN}$ to the output voltage $V_O$. However, the problem of source follow regulator is high dropout voltage. The gate-to-source voltage $Vgs_1$ has to be higher than a threshold voltage $V_T$ of the N-type pass transistor 10 in order to turn on the N-type pass transistor 10. Unfortunately, the difference in voltage between the unregulated DC input voltage $V_{IN}$ and the threshold voltage $V_T$ limits the highest output voltage $V_O$. The drain-to-source voltage $V_{DS1}$ is the voltage drop between the drain terminal D and the source terminal S of the N-type pass transistor 10 when the N-type pass transistor 10 is off-sate.

FIG. 2 shows a basic configuration of the LDO regulator. The LDO regulator includes a P-type pass transistor 20, a feedback-control circuit 21 and a voltage divider 22. The voltage divider 22 includes two resistors 221 and 222. The feedback-control circuit 21 includes an error amplifier 211 and the reference voltage $V_{REF}$ is transmitted to the negative input of the error amplifier 211. The output of the error amplifier 211 is connected to the gate terminal G of the P-type pass transistor 20.

The unregulated DC input voltage $V_{IN}$ is transmitted to the source terminal S of the P-type pass transistor 20. The P-type pass transistor 20 outputs the regulated DC output voltage $V_O$ from the drain terminal D. The DC output voltage $V_O$ is transmitted from the positive input of the error amplifier 211 through the resistors 221 and 222. The reference voltage $V_{REF}$ is transmitted to the negative input of the error amplifier 211. The advantage of the LDO circuits is low dropout voltage. The P-type pass transistor 20 is turned on as long as the source-to-gate voltage $Vgs_2$ is higher than its threshold voltage. The output of the error amplifier 211 is pulled to ground, which achieves very low input-to-output voltage of LDO regulator. The drain-to-source voltage $V_{DS2}$ is the voltage drop between the drain terminal D and the source terminal S of the P-type pass transistor 20 when the P-type pass transistor 20 is off-sate.

The problem of LDO regulator is that they are prone to instability at high input voltage $V_{IN}$. The P-type pass transistor 20 contributes a significant gain into the feedback loop. Furthermore, due to the Miller effect, a parasitic capacitor 23 causes a high capacitance at the output of the error amplifier 211, which introduces a pole into the feedback loop to influence the transfer function of LDO regulator. The error amplifier 211 is thus required to have low output impedance to shift the pole to higher frequency for the loop stability. However, it is difficult to achieve low output impedance for the error amplifier 211, especially at high input voltage $V_{IN}$.

Another problem of the LDO regulator is poor PSRR. The input voltage $V_{IN}$ is transmitted to the source terminal S of the P-type pass transistor 20, which is low impedance. The noise of the input voltage $V_{IN}$ disrupts the source-to-gate voltage $Vgs_2$ of the P-type pass transistor 20 easily. Therefore, a need exists for an improved low dropout regulator that is with high PSRR and operates in wider range of input voltage.

SUMMARY OF THE INVENTION

An objective of the invention is to provide a low dropout (LDO) regulator that operates in wide input range and with high PSRR particularly at high input voltage.

In accordance with the invention, a low dropout regulator is provided. The low dropout regulator includes an N-type pass transistor, a P-type pass transistor, a control circuit, a voltage divider, an input terminal and an output terminal. The N-type pass transistor supplies power to the output terminal and the drain terminal of the N-type pass transistor is coupled to the input terminal. The source terminal of the N-type pass transistor is coupled to the output terminal. The P-type pass transistor is connected with N-type pass transistor in parallel. The source terminal of the P-type pass transistor is coupled to the input terminal, and the drain terminal of the P-type pass transistor is coupled to the output terminal.

A reference signal is transmitted to the control circuit. The control circuit is coupled to the output terminal to control the N-type pass transistor and the P-type pass transistor to generate a first output voltage and a second output voltage in accordance with the reference signal. The first output voltage is designed higher than the second output voltage. The first output voltage is generated when the input voltage is higher than a threshold voltage. The second output voltage is generated when the input voltage is lower than the threshold voltage.

In accordance with the invention, the LDO regulator further includes a detection circuit used to disable the P-type pass transistor when the input voltage is higher than an input threshold voltage. Therefore the LDO regulator is operated as source follow regulator to achieve high PSRR and loop stability when the input-to-output voltage of the LDO regulator is high. The LDO regulator would accomplish low dropout voltage when the input-to-output voltage is low.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
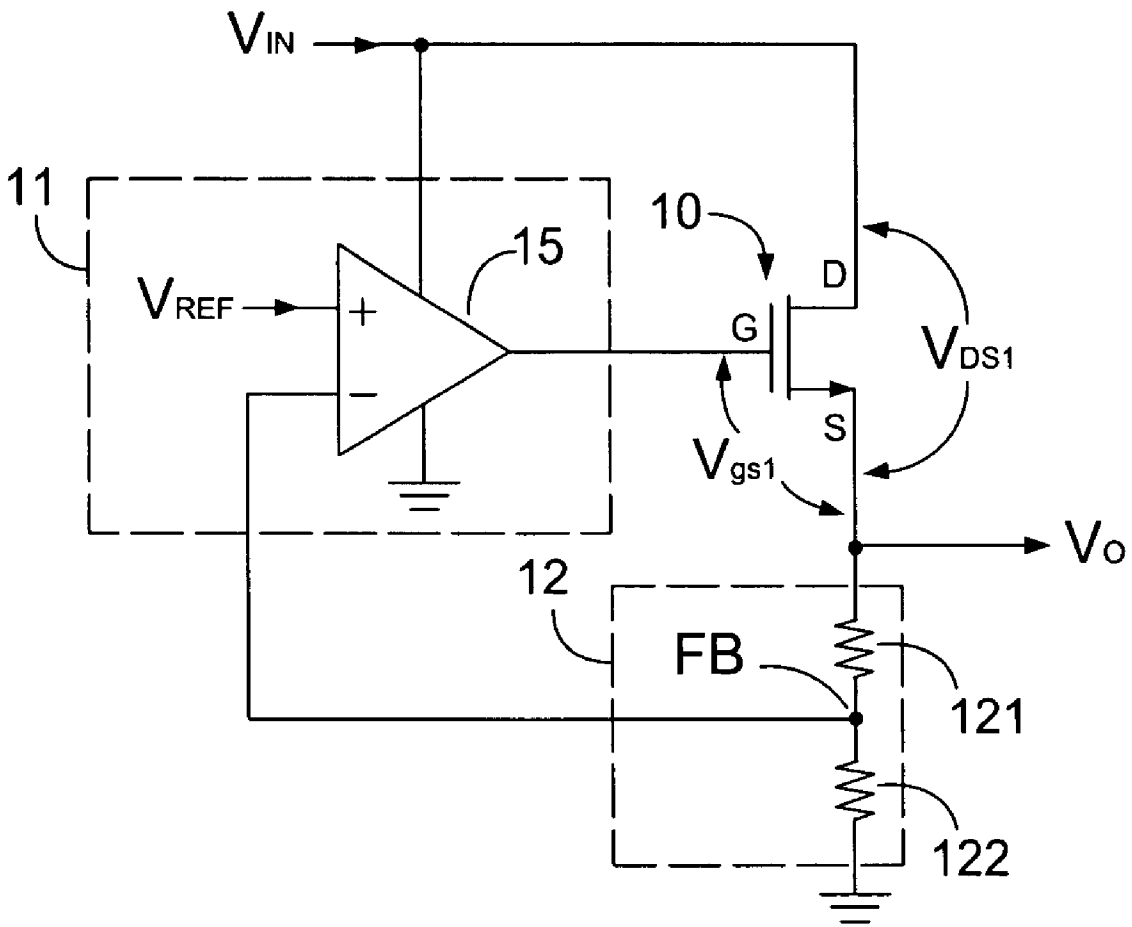
FIG. 1 (PRIOR ART)
FIG. 1 shows a circuit diagram of a conventional source follow regulator.
Figure 2:
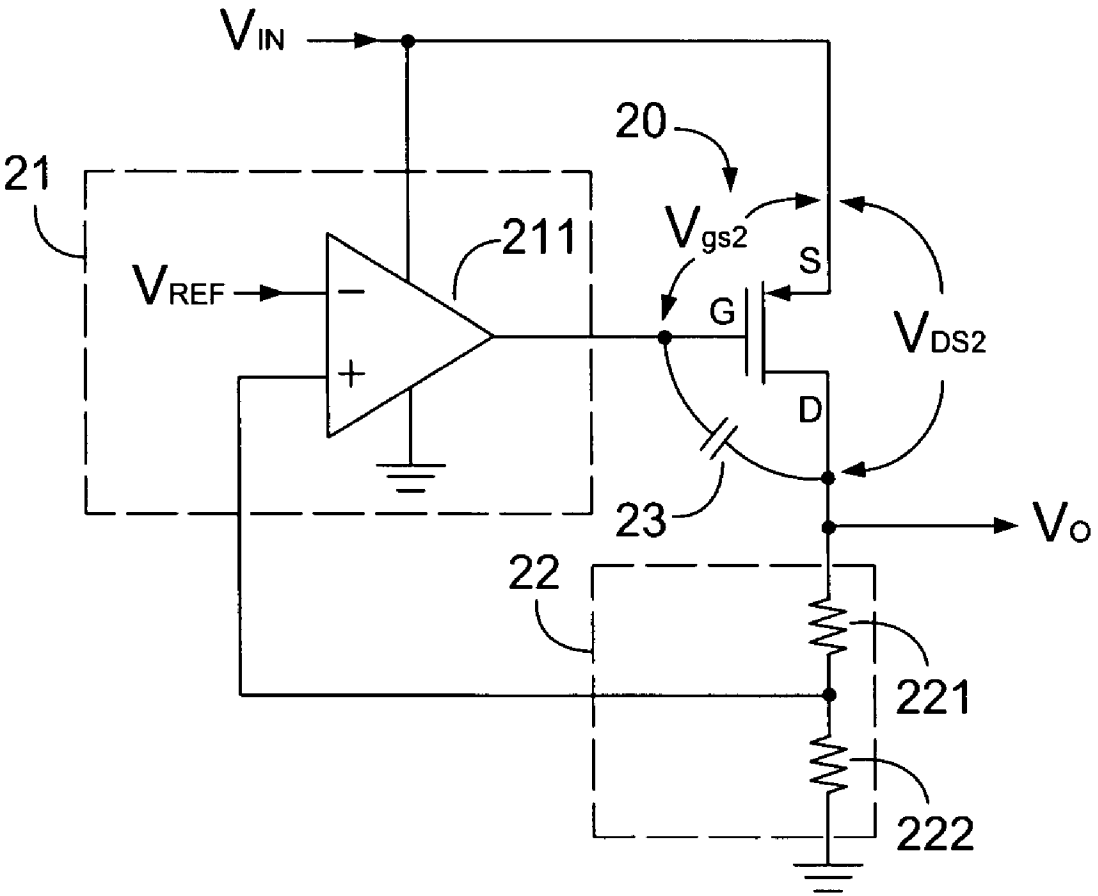
FIG. 2 (PRIOR ART)
FIG. 2 shows a circuit diagram of a conventional LDO regulator.
Figure 3:
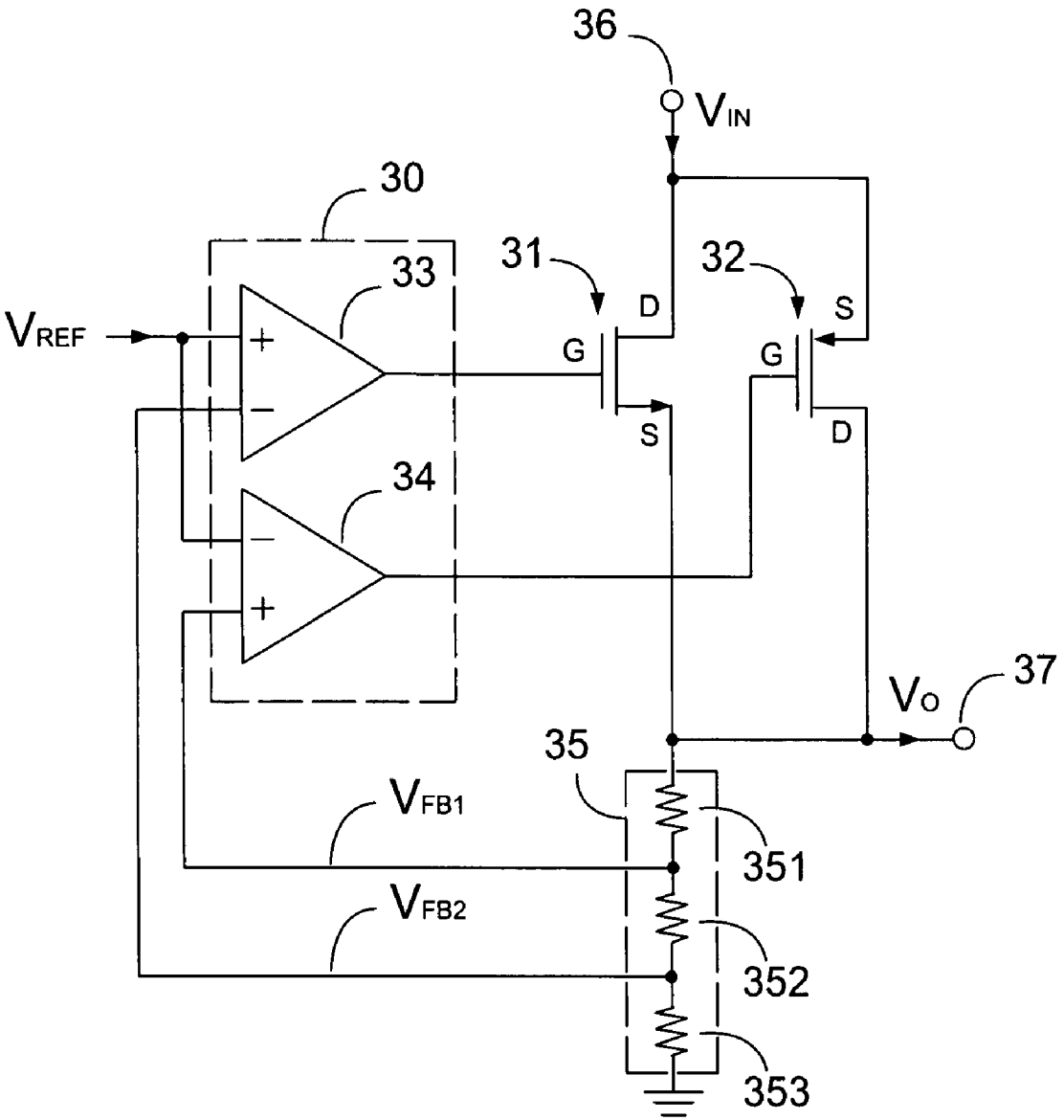
FIG. 3 shows a circuit diagram of a preferred embodiment of a LDO regulator according to the present invention.

FIG. 3 illustrates a circuit diagram of a preferred embodiment of a LDO regulator of the invention. The LDO regulator includes an N-type pass transistor 31, a P-type pass transistor 32, a control circuit 30, a voltage divider 35, an input terminal 36 and an output terminal 37. The LDO regulator receives an unregulated DC input voltage $V_{IN}$ from the input terminal 36 and outputs a regulated DC output voltage $V_O$ from the unregulated DC voltage input voltage $V_{IN}$ after regulating. The N-type pass transistor 31 supplies power from the input terminal 36 to the output terminal 37. The N-type pass transistor 31 includes a drain terminal D, a source terminal S and a gate terminal G. The drain terminal D is coupled to the input terminal 36. The source terminal S is coupled to the output terminal 37. The P-type pass transistor 32 is connected with the N-type pass transistor 31 in parallel. The P-type pass transistor 32 also includes a drain terminal D, a source terminal S and a gate terminal G. The source terminal S is coupled to the input terminal 36. The drain terminal D is coupled to the output terminal 37.

As shown in FIG. 3, the control circuit 30 includes two error amplifiers 33, 34. A reference signal $V_{REF}$ is transmitted to the control circuit 30. The error amplifier 33 is coupled to the output terminal 37 through the voltage divider 35. The voltage divider 35 consists of resistors 351, 352 and 353 and generates a first feedback signal $V_{FB1}$ and a second feedback signal $V_{FB2}$ coupled to the error amplifiers 33 and 34 respectively. The second feedback signal $V_{FB2}$ is higher than the first feedback signal $V_{FB1}$. The error amplifier 33 controls the N-type pass transistor 31 to generate a first output voltage $V_{O1}$ in accordance with the reference signal $V_{REF}$. The other error amplifier 34 is coupled to the output terminal 37 through the voltage divider 35 and controls the P-type pass transistor 32 to generate a second output voltage $V_{O2}$ in accordance with the reference signal $V_{REF}$. The first output voltage $V_{O1}$ and the second output voltage $V_{O2}$ are defined by equations (1) and (2):

$$V_{O1} = V_{REF} \times \frac{R_{351} + R_{352} + R_{353}}{R_{353}} \tag{1}$$

$$V_{O2} = V_{REF} \times \frac{R_{351} + R_{352} + R_{353}}{R_{352} + R_{353}} \tag{2}$$

where the $R_{351}$ is resistance of the resistor 351; the $R_{352}$ is resistance of the resistor 352; and the $R_{353}$ is resistance of the resistor 353. Hence, the first output voltage $V_{O1}$ is slightly higher than the second output voltage $V_{O2}$.

The N-type pass transistor 31 supplies the first output voltage $V_{O1}$ once the N-type pass transistor 31 is turned on for generating the first output voltage $V_{O1}$ to the output terminal 37. When the input voltage $V_{IN}$ is too low to turn on the N-type pass transistor 31, the P-type pass transistor 32 is turned on for generating the second output voltage $V_{O2}$ to the output terminal 37. The N-type pass transistor 31 and the P-type pass transistor 32 are connected in parallel to the output terminal 37. Therefore, the first output voltage $V_{O1}$ is generated to the output terminal 37 when the input voltage $V_{IN}$ is higher than a threshold voltage $V_{TH}$. The second output voltage $V_{O2}$ is generated to the output terminal 37 when the input voltage $V_{IN}$ is lower than the threshold voltage $V_{TH}$. The threshold voltage $V_{TH}$ is defined by equation (3):

$$V_{TH}=V_O+Vgs \tag{3}$$

where the Vgs is gate-to-source voltage of the N-type pass transistor 31, which is needed to turn on the N-type pass transistor 31, and the $V_O$ is the regulated DC output voltage.

Because the gain of the error amplifiers 33 and 34 are sufficient high, the P-type pass transistor 32 is disabled when the N-type pass transistor 31 is enabled. The differential voltage P V between the first output voltage $V_{O1}$ and the second output voltage $V_{O2}$ is designed to ignorable.

$$\Delta V=V_{O1}-V_{O2} \tag{4}$$

Figure 4:
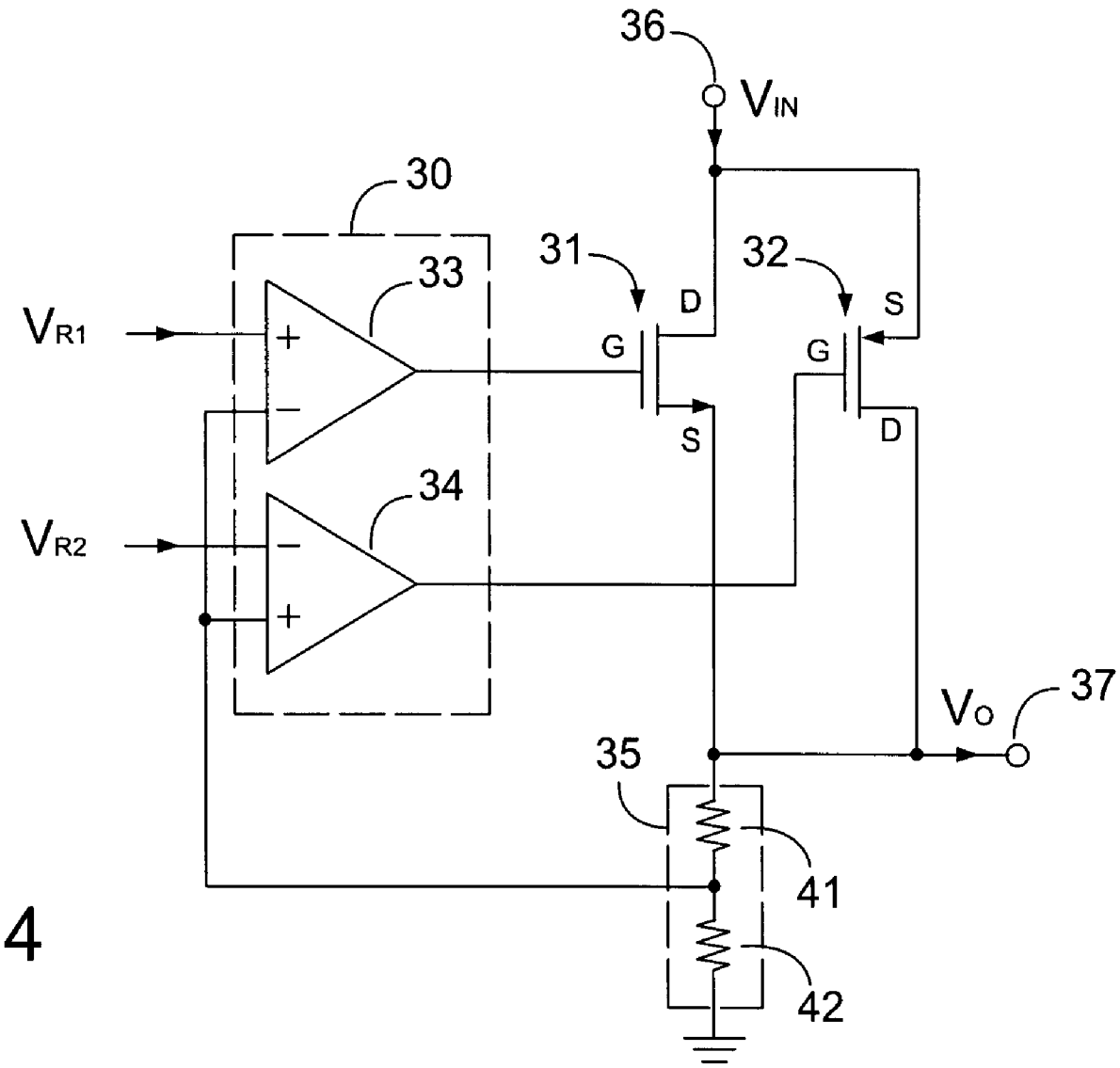
FIG. 4 shows a circuit diagram of a preferred embodiment of another LDO regulator according to the present invention.

FIG. 4 shows a circuit diagram of a preferred embodiment of another LDO regulator according to the invention. Two reference signals, a first reference signal $V_{R1}$ and a second reference signal $V_{R2}$, are transmitted to the error amplifiers 33 and 34 respectively. In this embodiment, the voltage divider 35 consists of resistors 41 and 42. The error amplifiers 33 and 34 are coupled to the output terminal 37 through resistors 41 and 42. The error amplifiers 33 and 34 control the N-type pass transistor 31 and the P-type pass transistor 32 to generate a first output voltage $V_{O3}$ in accordance with the reference signal $V_{R1}$ and a second output voltage $V_{O4}$ in accordance with the reference signal $V_{R2}$ respectively. The first output voltage $V_{O3}$ is designed higher than the second output voltage $V_{O4}$. The first output voltage $V_{O3}$ and the second output voltage $V_{O4}$ are defined by equations (5) and (6):

$$V_{O3} = V_{R1} \times \frac{R_{41} + R_{42}}{R_{42}} \tag{5}$$

$$V_{O4} = V_{R2} \times \frac{R_{41} + R_{42}}{R_{42}} \tag{6}$$

where the $R_{41}$ is resistance of the resistor 41; and the $R_{42}$ is resistance of the resistor 42.

The first reference signal $V_{R1}$ is designed a little bit higher than the second reference signal $V_{R2}$. Therefore, the N-type pass transistor 31 supplies the first output voltage $V_{O3}$ once the N-type pass transistor 31 is turned on for generating the first output voltage $V_{O3}$ to the output terminal 37. When the input voltage $V_{IN}$ is too low to turn on the N-type pass transistor 31, the P-type pass transistor 32 is turned on for generating the second output voltage $V_{O4}$ to the output terminal 37.

Figure 5:
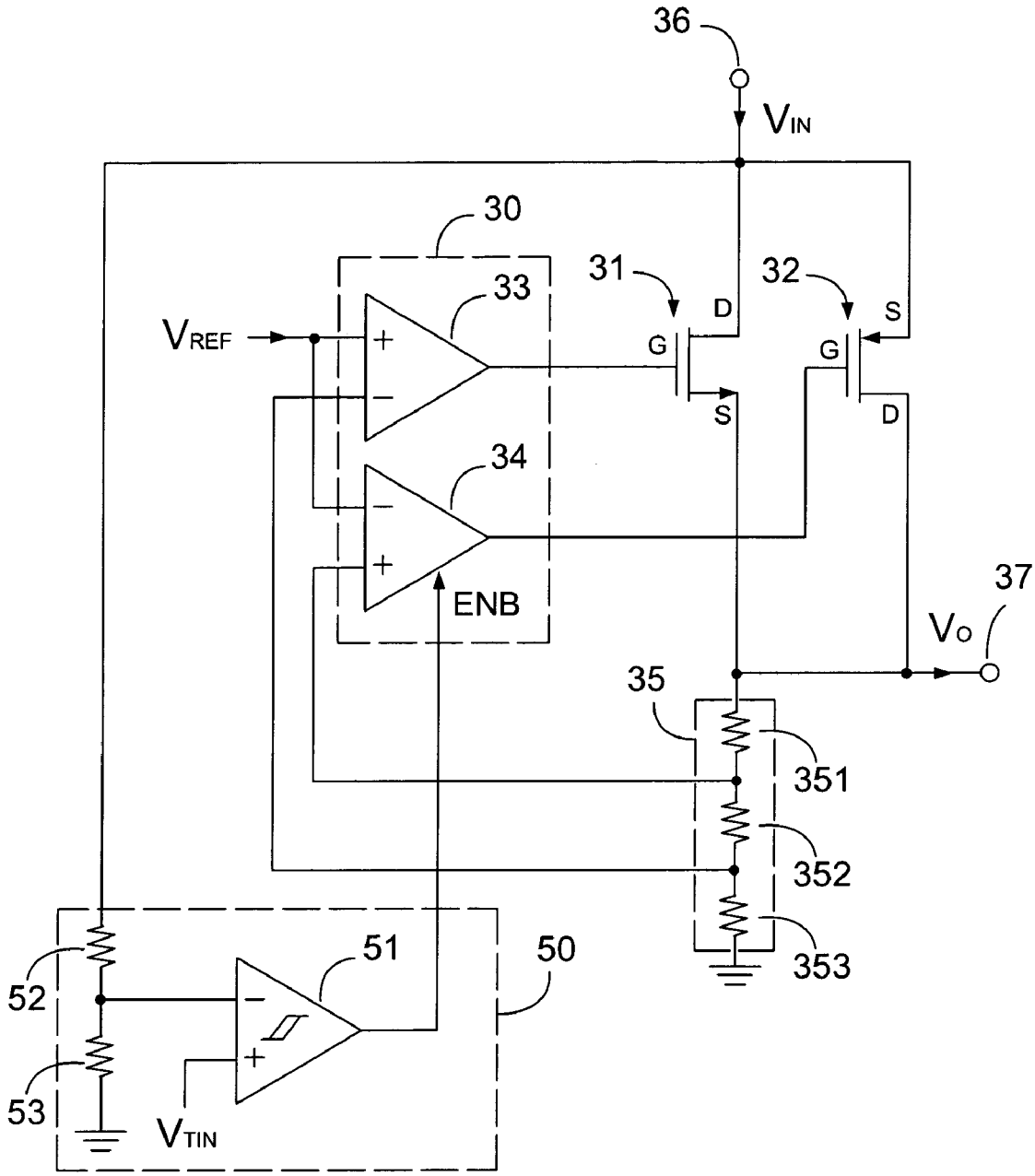
FIG. 5 shows a circuit diagram of a preferred embodiment of a LDO regulator with an input voltage detection circuit according to the present invention.

FIG. 5 shows a circuit diagram of a preferred embodiment of a LDO regulator with an input voltage detection circuit 50 according to the present invention. The input voltage detection circuit 50 is utilized to disable the P-type pass transistor 32 without going through the feedback loop when the input voltage $V_{IN}$ is high, which improve the transient response during high input voltage $V_{IN}$. The input voltage detection circuit 50 includes a comparator 51 and two resistors 52, 53. The positive input terminal of the comparator 51 receives an input threshold voltage $V_{TIN}$. The negative input terminal of the comparator 52 is coupled to the input terminal 36 to detect the input voltage $V_{IN}$ through resistors 52 and 53. The output terminal of the comparator 51 generates a feedforward signal $E_{NB}$ coupled to the error amplifier 34 to disable the P-type pass transistor 32 once input voltage $V_{IN}$ is higher than the input threshold voltage $V_{TIN}$. The present LDO regulator is operated as source follow regulator to achieve high PSRR and loop stability when the input-to-output voltage of the LDO regulator is high. The LDO regulator would accomplish low dropout voltage when the input-to-output voltage of the LDO regulator is low.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A low dropout regulator comprising:

an input terminal, for receiving an input voltage;

an output terminal, for outputting an output voltage from the input voltage after regulating;

a N-type pass transistor, for supplying power from the input terminal to the output terminal, the N-type pass transistor having a drain terminal, a source terminal, and a gate terminal, wherein the drain terminal is coupled to the input terminal, and the source terminal is coupled to the output terminal;

a P-type pass transistor, for supplying power from the input terminal to the output terminal, the P-type pass transistor having a drain terminal, a source terminal, and a gate terminal, wherein the source terminal is coupled to the input terminal, and the drain terminal is coupled to the output terminal; and a control circuit, for controlling the gate terminals of the N-type pass transistor and the P-type pass transistor to turn-one one of the N-type pass transistor and the P-type pass transistor to output the regulated voltage and to turn-off another of the N-type pass transistor and the P-type pass transistor;

wherein the control circuit includes two error amplifiers, being used to control the N-type pass transistor for generating a first output voltage at the output terminal and to control the P-type pass transistor for generating a second output voltage at the output terminal.

2. The low dropout regulator of claim 1, further comprising:

a voltage divider, coupled to the output terminal to generate a first feedback signal and a second feedback signal in accordance with the output voltage;

wherein the control circuit receives a reference voltage and controls the N-type pass transistor in accordance with the reference voltage and the first feedback signal, and the P-type pass transistor in accordance with the reference voltage and the second feedback signal.

3. The low dropout regulator of claim 2, wherein the second feedback signal is higher than the first feedback signal.

4. The low dropout regulator of claim 1, further comprises a detection circuit coupled to the input terminal to disable the P-type pass transistor when the input voltage is higher than an input threshold.

5. The low dropout regulation circuit of claim 4, wherein the detection circuit includes at least two resistors.

6. The low dropout regulation circuit of claim 1, wherein the first output voltage is generated when the unregulated DC voltage is higher than a threshold voltage and the second output voltage is generated when the unregulated DC voltage is lower than the threshold voltage, wherein the first output voltage is higher than the second output voltage.

7. A regulating method by a low dropout regulator, the low dropout regulator includes an N-type pass transistor, a P-type pass transistor, a control circuit, an input terminal and an output terminal, comprising the following steps:

receiving an unregulated DC voltage by the input terminal;

generating a first output voltage to the output terminal by the N-type pass transistor regulates the unregulated DC voltage when the unregulated DC voltage is higher than an input threshold; and generating a second output voltage to the output terminal by the P-type pass transistor regulates the unregulated DC voltage when the unregulated DC voltage is lower than an input threshold.

8. The regulating method of claim 7, wherein the control circuit is used to control the N-type pass transistor for generating a first output voltage at the output terminal and to control the P-type pass transistor for generating a second output voltage at the output terminal.

9. The regulating method of claim 7, wherein the control circuit receives a reference voltage and controls the N-type pass transistor in accordance with the reference voltage and a first feedback signal, and the P-type pass transistor in accordance with the reference voltage and a second feedback signal.

* * * * *